United States Patent [19]

Nakamura

[11] Patent Number: 4,595,193

[45] Date of Patent: Jun. 17, 1986

[54] STACKING APPARATUS FOR PAPER SHEETS

[75] Inventor: Kunihiko Nakamura, Yokohama, Japan

[73] Assignee: Tokyo Shibaura Denki Kabushiki Kaisha, Kawasaki, Japan

[21] Appl. No.: 588,364

[22] Filed: Mar. 12, 1984

[30] Foreign Application Priority Data

Mar. 16, 1983 [JP] Japan ..... 58-42344

[51] Int. Cl.[4] ..... B65H 29/40

[52] U.S. Cl. ..... 271/187; 271/189; 271/218; 271/315

[58] Field of Search ..... 271/315, 187, 189, 213, 271/218

[56] References Cited

U.S. PATENT DOCUMENTS

| | | | |
|---|---|---|---|
| 4,228,997 | 10/1980 | Schoonmaker | 271/213 |
| 4,470,590 | 9/1984 | Ariga | 271/315 X |
| 4,501,418 | 2/1985 | Ariga | 271/218 X |

FOREIGN PATENT DOCUMENTS

| | | |
|---|---|---|
| 1079078 | 4/1960 | Fed. Rep. of Germany . |
| 2461002 | 4/1976 | Fed. Rep. of Germany . |
| 0059101 | 9/1982 | Japan . |

*Primary Examiner*—Richard A. Schacher

*Attorney, Agent, or Firm*—Oblon, Fisher, Spivak, McClelland & Maier

[57] ABSTRACT

A stacking apparatus for paper sheets has a transporting belt mechanism for sequentially supplying paper sheets one by one at predetermined intervals, rotatable blade wheels for receiving the paper sheets in elongated spaced defined therebetween, a stationary stop for abutting against the paper sheet rotated together with the blade wheels to remove each paper sheet from the space and for dropping the paper sheet toward a predetermined stacking position of a stacking unit, separators which are coaxially rotated together with the blade wheels without being brought into contact with the paper sheets inserted in the spaces, which stop at a receiving hand immediately before a first paper sheet drops from the blade wheels and which receive the subsequent paper sheets, which are started when a predetermined number of paper sheets previously stacked in the stacking position is cleared away by the stacking unit, which transfer the paper sheets from the receiving hand to the stacking position, and which are operated such that the paper sheets discharged from the blade wheels are directly stacked on the stacking position until the first paper sheet of the next group having the predetermined number of paper sheets drops, and a control circuit for controlling the blade wheels, the separators, and a controlling unit to achieve the operation mentioned above.

10 Claims, 15 Drawing Figures

STACKING APPARATUS FOR PAPER SHEETS

BACKGROUND OF THE INVENTION

The present invention relates to a stacking apparatus for paper sheets having: blade wheel means which is rotated such that an axis of rotation thereof is horizontally aligned and which has elongated wheel blades each extending in a direction opposite to a rotational direction of the blade wheel means from a center portion about the axis of rotation to a peripheral surface of the blade wheel means; feeding means for feeding paper sheets one by one in each of elongated spaces formed between every two adjacent blades of the elongated blades, at a speed exceeding a peripheral velocity of the blade wheel means; and stacking means for stacking the paper sheets sorted by and sequentially discharged in groups of predetermined number, from the blade wheel means.

Paper sheets such as bank notes, data cards, or printed matter are automatically handled. These documents have been increasing year by year. A strong demand has arisen for a machine handling these paper sheets at high speed.

A typical example is a bundling operation for recycling a predetermined number of currency notes. Manual counting and bundling of currency notes is time-consuming and cumbersome. In practice, currency notes are automatically grouped in units of a predetermined number and bundled by a currency note arranger or the like. In the automatic currency note arranger of this type, it is assumed ideal that the currency notes transported at high speed are continuously stacked in units of predetermined numbers without interruption.

Under this condition, there is conventionally provided a stacking means called a beat (direction changing) method in which a paper sheet, discharged from the transporting end and floating in air, is beaten towards a perpendicular direction and dropped onto a stacking unit. However, direction changing means of this type has a limited response speed. More specifically, when a direction changing member vibrates with a given magnitude at high speed, the vibration cycle is increased and with it the inertia force. As a result, operation of the direction changing means becomes unstable. In addition, the force acting on the mechanism of the direction changing means is increased, the means must have a large construction as a whole which results in malfunctions and high cost. In addition to these disadvantages, the force beating the paper sheet is increased, so that the sheet tends to be torn. Therefore, this direction changing means is not suitable for high-speed operation.

A blade wheel is used to overcome the above-mentioned stacking means. The blade wheel has wheel blades, each extending from the center portion to the peripheral surface of the blade wheel. The wheel blades extend in the opposite direction to the rotational direction of the wheel. The paper sheets are inserted in the narrow spaces formed between the blades of the wheel and are stacked. According to this method, the time interval t (min.), during which the leading end of a given paper sheet passes and the leading end of the next paper sheet arrives, is given by observing the paper sheets at a given position along a transporting passage, from:

$$t=1/N$$

where N is the number of paper sheets fed per minute into the wheel. When the wheel has m narrow spaces between every two adjacent blades, the wheel must be rotated by 1/m revolution during the time interval t. In order to sequentially insert the paper sheets in the corresponding narrow spaces, a rotational speed n (rpm) of the wheel is given as follows:

$$n=(1/m)/(1/N)=N/m$$

As is apparent from the above equation, the rotational speed n of the wheel is obtained by dividing the number of fed sheets by the number of narrow spaces. The rotational speed of the wheel is very low. Assume that high-speed transportion is performed at the speed of 1800 sheets/min., and that the wheel has 18 narrow spaces. The rotational speed n of the wheel is thus given as 100 rpm (=1800/18). The sheets can be easily stacked at this low speed without any problem.

The blade wheel method has various advantages compared with any other method. Conventionally, a stacking apparatus for paper sheets is provided wherein the blade wheel stacking means is combined with means for sorting paper sheets into units of a predetermined number. According to this stacking apparatus, a separator has an arm having substantially the same axis of rotation as that of the wheel and extending from the center portion around the axis of rotation of the wheel to the outside of the peripheral surface of the wheel, along the side of the wheel. The separator also has a receiving portion integrally formed at the distal end of the arm. The separator is pivoted as needed to abut the arm against the paper sheet inserted between the blades, so the paper sheet is removed from the space formed between the corresponding blades. The paper sheet is temporarily held by the receiving portion. During this period, the sheets, previously discharged from a stationary stopper and stacked on the stacking means, are removed to a predetermined portion. Thereafter, the sheets stacked on the separator are transferred to the stacking means.

However, the following problem is presented by the conventional stacking apparatus having a combination of blade-wheel stacking means and the sorting means. When temporarily receiving paper sheets outside the predetermined number, the arm of the separator is used as a stopper to remove these subsequent paper sheets which are sequentially held by the receiving portion. The arm is located within the width, along the axis of rotation of the wheel, of the paper sheet insertion position in the space of the blade wheel. For this reason, when the separator is located between the sheet feeding position and the sorting start position (receiving start position), the sheet receiving depth of the space of the wheel becomes shallow due to the presence of the arm. Therefore, when the separator is located between the above-mentioned positions, only the leading end of the paper sheet is inserted in a given space, and the trailing end extends outside and blocks the next space. As a result, the next paper sheet cannot be inserted in the corresponding space and collides with the blocking paper sheet, causing a paper jam. In order to prevent this, the transport distance between the adjacent paper sheets approaching the blade wheel must be increased. This prohibits any increase in handling speed.

SUMMARY OF THE INVENTION

The present invention has been made in consideration of the above situation and has for its object to provide a stacking apparatus for paper sheets which does not impair the high-speed handling capacity inherent in a blade wheel stacking method and which is capable of sorting paper sheets into units of a predetermined number for stacking.

In order to achieve the above object of the present invention, there is provided a stacking apparatus for paper sheets comprising: a stationary stop for stopping rotation of the paper sheet corresponding one of the elongated spaces at a position where the paper sheet, inserted in a corresponding one of the elongated spaces, is rotated through at a predetermined angle of rotation of the blade wheel means and for removing the paper sheet from the corresponding space to drop the paper sheet; an arm which has the same axis of rotation as that of the blade wheel means and passing by the side of paper sheets, which is rotatably supported while the arm is not brought into contact with the paper sheet inserted in the elongated spaces, and which extends along a side surface of said blade wheel means; a receiving portion, supported by the arm and located outside a peripheral edge of the blade wheel means, so as to temporarily receive the paper sheet which naturally drops; and controlling means for controlling and driving the arm.

According to the stacking apparatus of the present invention, the paper sheet which is transported in the blade wheel means will not contact the arm irrespective of the position of the arm. Therefore, the paper sheet transported in the space of the blade wheel means can be completely and smoothly inserted in the space at high speed. Unlike in the conventional stacking apparatus, the distance between the adjacent paper sheets to be transported in the blade wheel can be shortened. For this reason, the paper sheets can be grouped and stacked in units of a predetermined number while high-speed handling of the blade wheel is maximized.

DETAILED DESCRIPTION OF THE PREFERRED EMBODIMENT

An embodiment of the present invention will now be described with reference to the accompanying drawings.

Figure 1:
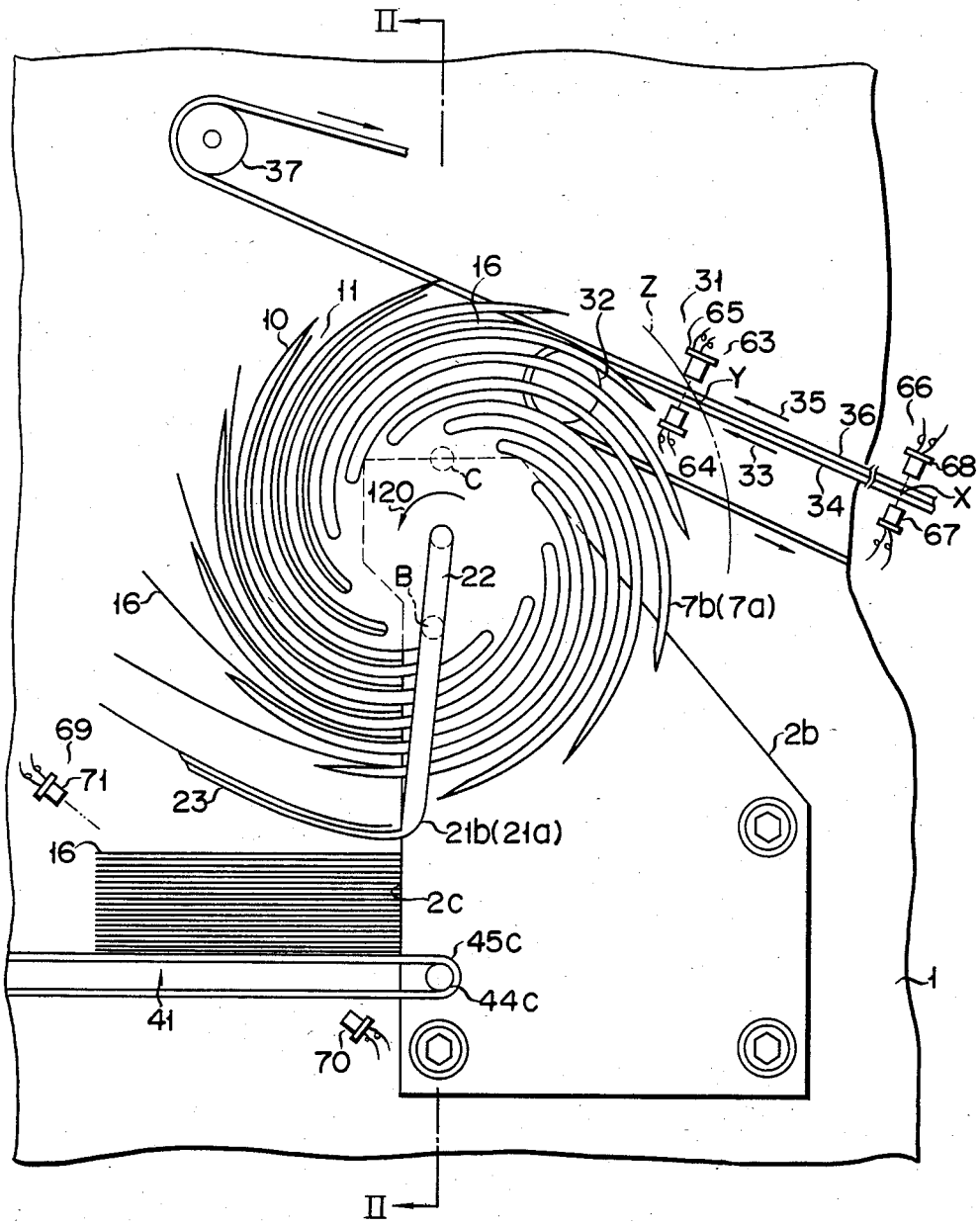
FIG. 1 is a partially cutaway side view showing the main part of a stacking apparatus for paper sheets according to an embodiment of the present invention.
Figure 2:
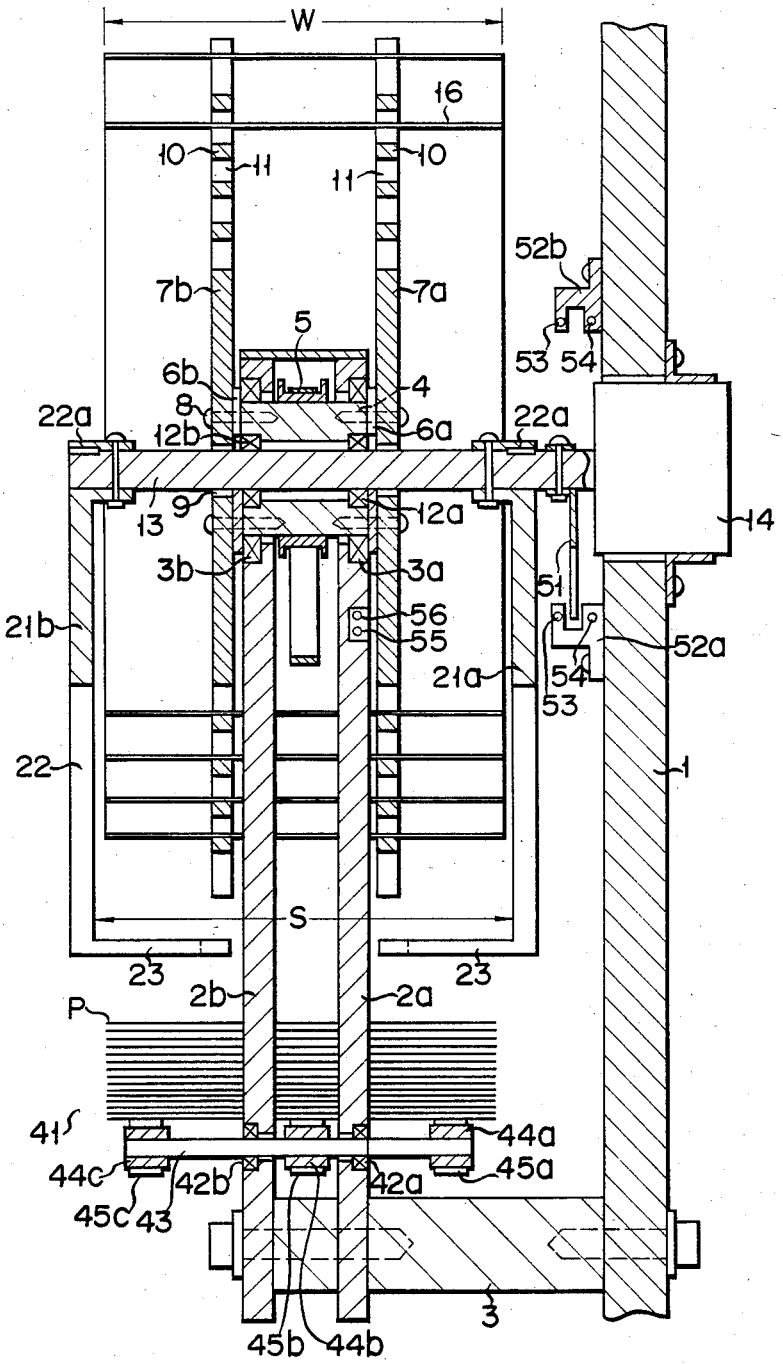
FIG. 2 is a cross-sectional view of the apparatus along the line II—II of FIG. 1.

FIG. 1 is a partially cutaway side view showing the main part of a stacking apparatus for paper sheets according to an embodiment of the present invention, and FIG. 2 is a cross-sectional view of the apparatus along the line II—II of FIG. 1;

Referring to FIGS. 1 and 2, reference numeral 1 denotes a vertical base plate. A pair of support plates 2*a* and 2*b* are disposed on one side surface of the base plate 1. The support plates 2*a* and 2*b* are spaced apart from each other and are parallel to the side surface of the base plate 1. The lower ends of the support plates 2*a* and 2*b* are mounted on the base plate 1 through a support plate 3. The support plates 2*a* and 2*b* have vertical surfaces 2*c* at the lower portions of the left end walls thereof (FIG. 1). These vertical surfaces 2*c* serve as stoppers for stopping the movement of the paper sheet (to be described later) and will be referred to as stoppers 2*c*.

The outer rings of bearings 3*a* and 3*b* are mounted coaxially on the support plates 2*a* and 2*b* in a direction perpendicular to the side surface of the base plate 1. A hollow pulley 4 is rotatably mounted on the inner rings of the bearings 3*a* and 3*b*. An endless belt 5 is looped around the outer surface of the pulley 4 at one side and is coupled to a driving source (not shown) at the other side, so that the pulley is driven at a predetermined speed. Blade wheel means (i.e., a pair of blade wheels) are coaxially coupled by bolts 8 on the shaft at the two end surfaces of the pulley 4, through spacers 6*a* and 6*b* respectively. The distance between blade wheels 7*a* and 7*b* is shorter than a width W of a paper sheet 16. Holes 9 are respectively formed at the centers of the blade wheels 7*a* and 7*b* and have substantially the same inner diameter as that of the pulley 4. Elongated blades 10 extend in a direction opposite to the rotational direction of the wheels 7*a* and 7*b* and from the center portion to the peripheral portion of the wheels 7*a* and 7*b*, as if the blades 10 draw an involute curve, as shown in FIG. 1. Each elongated space 11 is formed between every two adjacent blades 10. The blade wheels 7*a* and 7*b* are mounted on the pulley 4 such that the spaces 11 of the blade wheels 7*a* and 7*b* are aligned with each other along the direction of the shaft 13.

The outer rings of bearings 12*a* and 12*b* are coaxially mounted at two ends of the inner surface of the pulley 4. The shaft 13 is rotatably mounted on the inner rings of the bearings 12*a* and 12*b*. One end of the shaft 13 extends outside the blade wheel 7*b* without being brought into contact with the hole 9 therein. The other end of the shaft 13 also extends outside the blade wheel 7*a* without being brought into contact with the hole 9 therein and is coupled to the rotating shaft of a pulse motor 14 mounted on the base plate 1. A pair of separators 21*a* and 21*b* are mounted on the shaft 13 to sandwich the blade wheels 7*a* and 7*b* therebetween.

Figure 3:
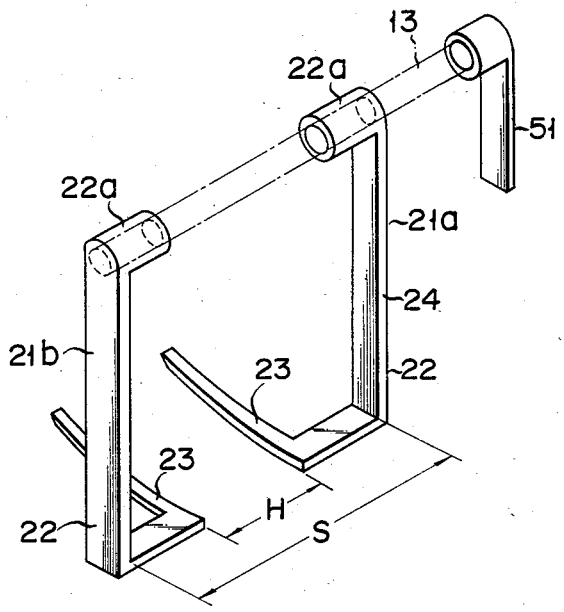
FIG. 3 is a perspective view of a separator built into the apparatus of FIG. 1.

As illustrated separately in FIG. 3, the separators 21*a* and 21*b* have arms 22 and receiving portions or receiving hands 23. The arms 22 are parallel to the outer side surfaces of the blade wheels 7*a* and 7*b* and extend outside the peripheral edges thereof. The receiving hands 23 extends from the distal ends of the corresponding arms 22 parallel to the shaft 13, towards the blade wheels 7*a* and 7*b*, and then towards imaginary arcs having as their center the axis of the shaft 13, protruding by a length more than half that of the paper sheet 16 along the blades 10 of the blade wheels 7*a* and 7*b*, respectively. The separators 21*a* and 21*b* are so aligned that end faces 24 of the arms 22 are disposed on the same plane. Proximal ends 22*a* of the arms 22 are mounted on the shaft 13 such that a distance S (FIG. 3) between the arms 22 is longer than the width W of the paper sheet 16. In this condition, the receiving portions (i.e., the receiving hands 23) are spaced apart from each other by a distance H which is equal to the distance between the blade wheels 7*a* and 7*b*. The receiving hands 23 are integrally formed with the arms 22. The receiving hands 23 are located outside imaginary circles drawn by the blade wheels 7*a* and 7*b*.

A transporting or conveyer belt mechanism 31 (FIG. 1) is disposed in the upper portion between the blade wheels 7*a* and 7*b* to transport the paper sheet 16 into the corresponding spaces 11 of the blade wheels 7*a* and 7*b*. The belt mechanism 31, as the feeding means, comprises: a pulley 32 disposed between the blade wheels 7*a* and 7*b* such that the axis of rotation thereof is parallel to that of the shaft 13; two lower belts 34 looped around the pulley 32, parallel to each other at two different positions along a direction perpendicular to the drawing surface (FIG. 1), and guided through the pulley 32 along the direction of an arrow 33; two upper belts 36 guided in the direction of an arrow 35 up to the pulley 32, while the upper belts 36 overlap the upper surfaces of the lower belts 34 so as to transport the paper sheet 16 in a clamped manner in the overlapping interval; and a pulley 37 for turning back the upper belts 36 above the pulley 32. Therefore, the position where the lower belts 34 are separated from the upper belts 36 (i.e., the position where the paper sheet is fed) is located inside the peripheral edges of the blade wheels 7*a* and 7*b*. The pulleys 32 and 37 are supported on the base plate 1 through support members (not shown). The upper and lower belts 36 and 34 are driven at an identical speed which is higher than the peripheral velocity of the blade wheels 7*a* and 7*b*.

On the other hand, a stacking unit 41, as the stacking means, is disposed below the blade wheels 7*a* and 7*b*. As shown in FIG. 2, the stacking unit 41 comprises: bearings 42*a* and 42*b* whose outer rings are mounted in the lower portions of the support plates 2*a* and 2*b* parallel to the shaft 13; a shaft 43 mounted in the inner rings of the bearings 42*a* and 42*b*; pulleys 44*a*, 44*b* and 44*c* fixed on the surface of the shaft 43 and spaced apart from each other; a group of belts, i.e., belts 45*a*, 45*b* and 45*c* (only the belt 45*c* is shown to extend to the left, as illustrated in FIG. 1) looped around the pulleys 44*a*, 44*b* and 44*c* respectively; and a drive control unit for driving these belts.

Figure 4:
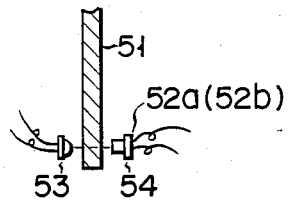
FIG. 4 is a representation of a separator detector arranged in the apparatus of FIG. 1.

One end of a bar 51 is fixed on the shaft 13 at a position near the pulse motor 14 and detects the positions of the separators 21*a* and 21*b*. As shown in FIG. 3, the bar 51 has substantially an equal width (along the peripheral direction) to that of the arm 22 of each of the separators 21*a* and 21*b*. The bar 51 is fixed to the shaft 13 such that the bar 51 extends in the same direction as that of the arm 22. As shown in FIG. 2, separator detectors 52*a* and 52*b* are fixed on a side surface of the base plate 1 to detect the rotational position of the bar 51 while the bar 51 is not brought into contact with the separator detectors 52*a* and 52*b*. Dotted circles B and C in each of FIGS. 1, 10, 12 and 15 indicate the separator detectors 52*b* and 52*a*. Each of the separator detectors 52*a* and 52*b* comprises a photocoupler consisting of a light-emitting element 53 and a light-receiving element 54, which are linearly aligned opposing each other, as shown in FIG. 4. Each of the separator detectors 52*a* and 52*b* generates a low level signal when the bar 51 is inserted between the corresponding elements 53 and 54 to shield light from the light-receiving element 54. Otherwise, each detector generates a high level signal. Therefore, the separator detector 52*a* generates a low level signal when the bar 51 (i.e., the arm 22 of the separators 21*b* (21*a*)) is located at a position indicated by the dotted circle B in FIG. 1. Similarly, the separator detector 52*b* generates a low level signal when the arm 22 of the separator 21*b* (21*a*) is located at a position indicated by the dotted circle C in FIG. 1. The positions B and C will be described in detail later. A recess 55 (FIG. 2) is formed in the surface of the support plate 2*a* which opposes the inner surface of the blade wheel 7*a*.

Figure 5:
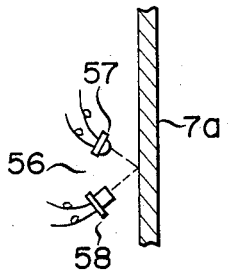
FIGS. 5 and 6 are representations of the arrangement of a pulse generator built into the apparatus of FIG. 1.
Figure 6:
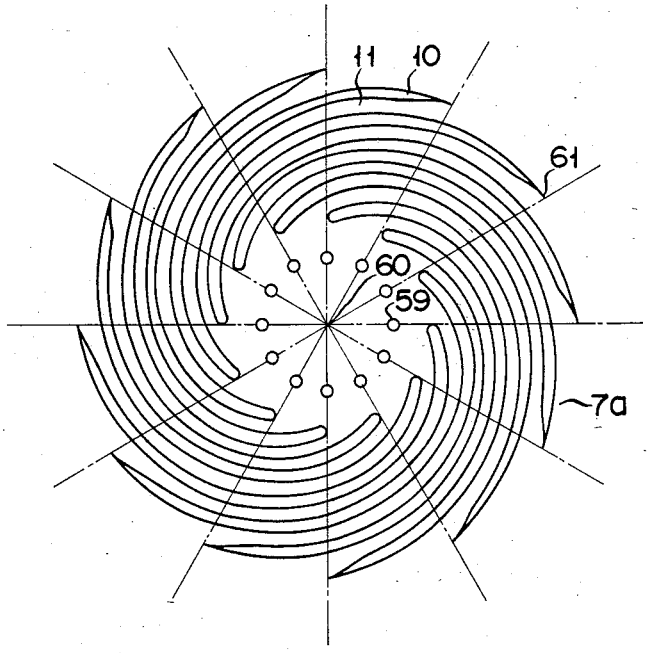

A pulse generator 56 is arranged in the recess 55 to generate pulses in synchronism with the rotation of the blade wheels 7*a* and 7*b*. As shown in FIG. 5, the pulse generator 56 comprises a photocoupler consisting of a light-emitting element 57 for emitting light towards the inner surface of the blade wheel 7*a* at a predetermined angle, and a light-receiving element 58 for receiving light reflected by the inner surface of the blade wheel 7*a*. As shown in FIG. 6, a plurality of apertures 59 is formed in a circular shape on the portion of the blade wheel 7*a* which receives the reflected light. The apertures 59 are formed at positions falling on lines connecting a center 60 of the blade wheel 7*a* and tips 61 of the blades 10. The pulse generator 56 generates an output signal when incident light on the light receiving element 58 transmited from the light-emitting element 57 through one of the apertures 59 is cut off. A paper number detector 63 is disposed in the vicinity of the feeding port of the paper sheet 16, in the overlapping portion between the upper and lower belts 36 and 34 of the belt mechanism 31, to count the number of paper sheets 16 conveyed while being clamped between the belts 34 and 36, and to generate an output pulse when a count thereof reaches a predetermined number plus one. The detector 63 comprises a light-emitting element 64 and a light-receiving element 65, which are disposed below and above the overlapping portion of the belts 34 and 36, between two pairs of belts 34 and 36, as shown in FIG. 1.

A paper flow detector 66 (FIG. 1) is arranged in the part of the overlapping portion, which is located upstream of the detector 63, and detects the flow of a paper sheet 16 clamped between the belts 34 and 36. The detector 66 comprises a photocoupler consisting of a light-emitting element 67 and a light-receiving element 68, which are arranged below and above the belts 34 and 36 respectively, between two pairs of belts 34 and 36. The detector 66 generates an output pulse when the paper sheet 16 has passed through it. A stacking detector 69 (FIG. 1) is disposed in the vicinity of the stacking unit 41. The detector 69 is arranged such that a light-emitting element 70 and a light-receiving element 71 are placed on an oblique line on a plane perpendicular to the shaft 13, as shown in FIG. 1. When the light-receiving element 71 receives light from the light-emitting element 70, it generates an output signal.

Figure 7:
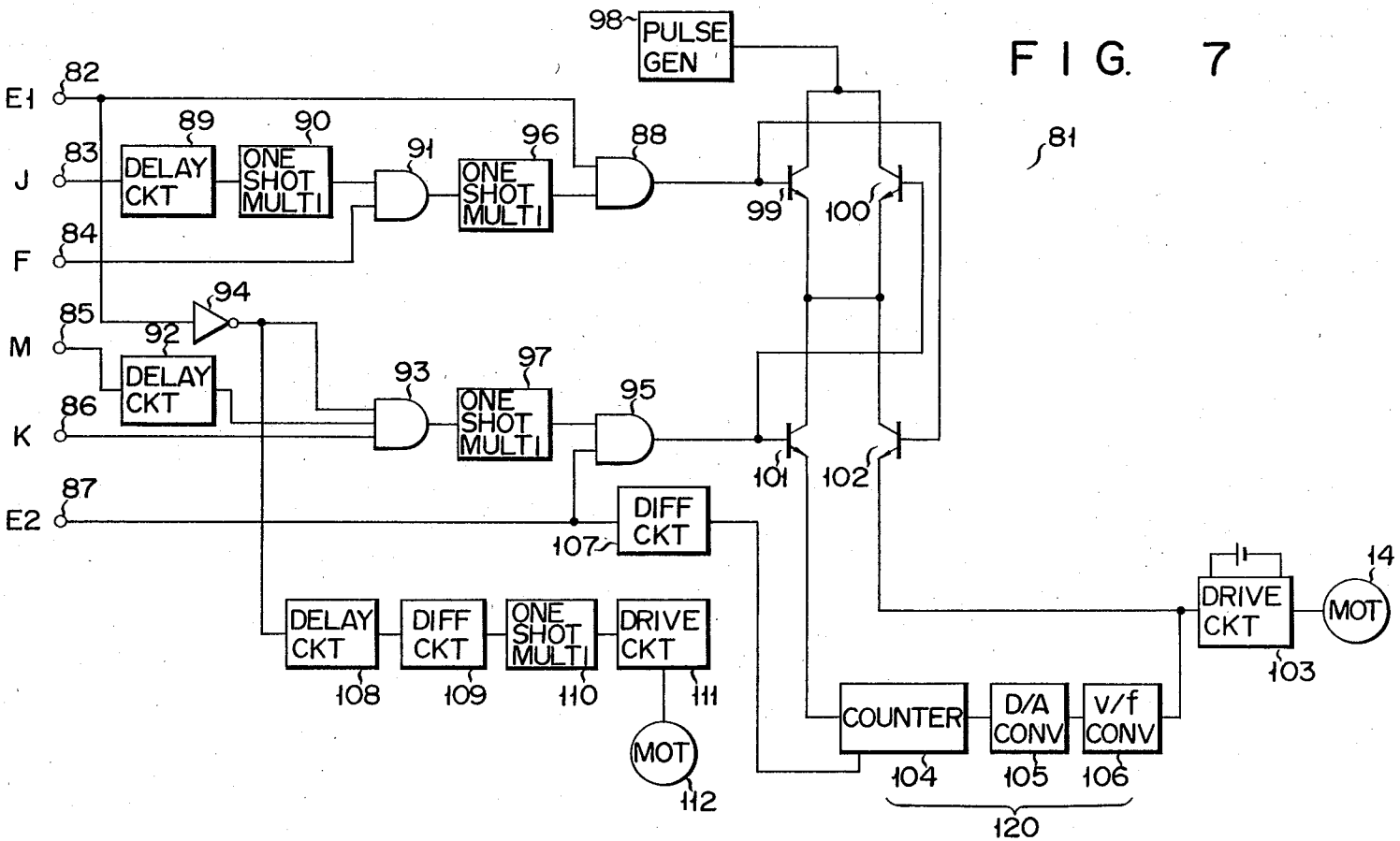
FIG. 7 is a block diagram of a drive control section of the apparatus shown in FIG. 1.

Outputs E1 and E2 from the separator detectors 52*a* and 52*b*, an output F from the pulse generator 56, an output J from the detector 63, an output K from the detector 66, and an output M from the detector 69 are supplied to a control unit 81 as the controlling means for driving the pulse motor 14 and the belts 45*a*, 45*b* and 45*c* of the stacking unit 41. The control unit 81 has a detailed configuration, as shown in FIG. 7. The control unit 81 has six input terminals 82, 83, 84, 85, 86 and 87. The output E1 from the detector 52*a* is supplied to the input terminal 82 and to one input terminal of an AND gate 88. The output J from the detector 63 is supplied to the input terminal 83 and to one input terminal of an AND gate 91 through a delay circuit 89 having a predetermined delay time and a one-shot multivibrator 90. The output F from the pulse generator 56 is supplied to the input terminal 84 and to the other input terminal of the AND gate 91. The output M from the detector 69 is supplied to the input terminal 85 and to the second input terminal of an AND gate 93 through a delay circuit 92. The output K from the detector 66 is supplied to the third input terminal of the AND gate 93 through the input terminal 86. The output E1 is supplied to the first input terminal of the AND gate 93 through an inverter 94. The output E2 from the detector **52*b* is supplied to the input terminal 87 and to one input terminal of an AND gate 95. An output from the AND gate 91 is supplied to the other input terminal of the AND gate 88 through a one-shot multivibrator 96. An output from the AND gate 93 is supplied to the other input terminal of the AND gate 95 through a one-shot multivibrator 97. A pulse generator 98 (to be described in detail later) is provided for generating a pulse having a period to be described later. The output terminal of the pulse generator 98 is connected to a common node of the collectors of npn transistors 99 and 100. The commonly connected emitters of the transistors 99 and 100 are connected to the collectors of npn transistors 101 and 102. An output from the AND gate 88 is commonly supplied to the bases of the transistors 99 and 102. An output from the AND gate 95 is commonly supplied to the bases of the transistors 100 and 101. An emitter output from the transistor 102 is supplied as a drive control signal to a drive circuit 103 for driving the pulse motor 14. An emitter output from the transistor 101 is supplied to a counter 104. An output from the counter 104 is supplied to the drive circuit 103 through a digital-to-analog converter 105 (to be referred to as a D/A converter hereinafter) and a voltage-to-frequency converter 106 (to be referred to as a V/f converter hereinafter). The counter 104 is reset in response to a differentiator circuit 107 for differentiating the trailing edge of the output E2. The electrical characteristics of the V/f converter 106 are preset in accordance with the position of the detector 66. An output from the inverter 94 is supplied to a differentiator circuit 109 through a delay circuit 108. The differentiator circuit 109 differentiates the leading edge of the output from the delay circuit 108. An output from the differentiator circuit 109 is supplied as a drive signal to a one-shot multivibrator 110. An output from the one-shot multivibrator 110 is supplied as a control signal to a drive circuit 111 for driving a motor 112 for moving the belts 45*a*, 45*b* and 45*c* of the stacking unit 41**.

The operation of the stacking apparatus, having the construction described above, will be described with reference to FIGS. 8 to 15.

Assume that the apparatus handles 1,200 paper sheets per minute. In order to satisfy the above assumption, the travel speed of the belt mechanism 31 and the feeding of the paper sheet 16 into the mechanism 31 must be preset such that a time interval is given to be 50 msec, during which the leading edge of a given paper sheet, transported by the belt mechanism 31, passes a given position and the leading edge of the next paper sheet reaches the given position. In this case, assume that a time interval is 25 msec, during which the trailing edge of the given paper sheet passes the given position and the leading edge of the next paper sheet reaches the given position. In order to satisfy the above condition, the rotational speed of the blade wheels **7*a* and 7*b* is set as follows. Since each blade wheel has 12 elongated spaces 11, the angle $\alpha$ of rotation of the blade wheel, corresponding to one space, is 30 degrees. This angular displacement is performed for a time interval of 50 msec, so the rotational speed N of each of the blade wheels 7*a* and 7*b* is set to be 100 rpm. Therefore, a driving source (not shown) drives the blade wheels 7*a* and 7*b* at a speed of 100 rmp in the direction indicated by an arrow 120 in FIG. 1, and the belts 34 and 36 travel along the arrows 33 and 35** respectively, satisfying the above conditions.

Figure 10:
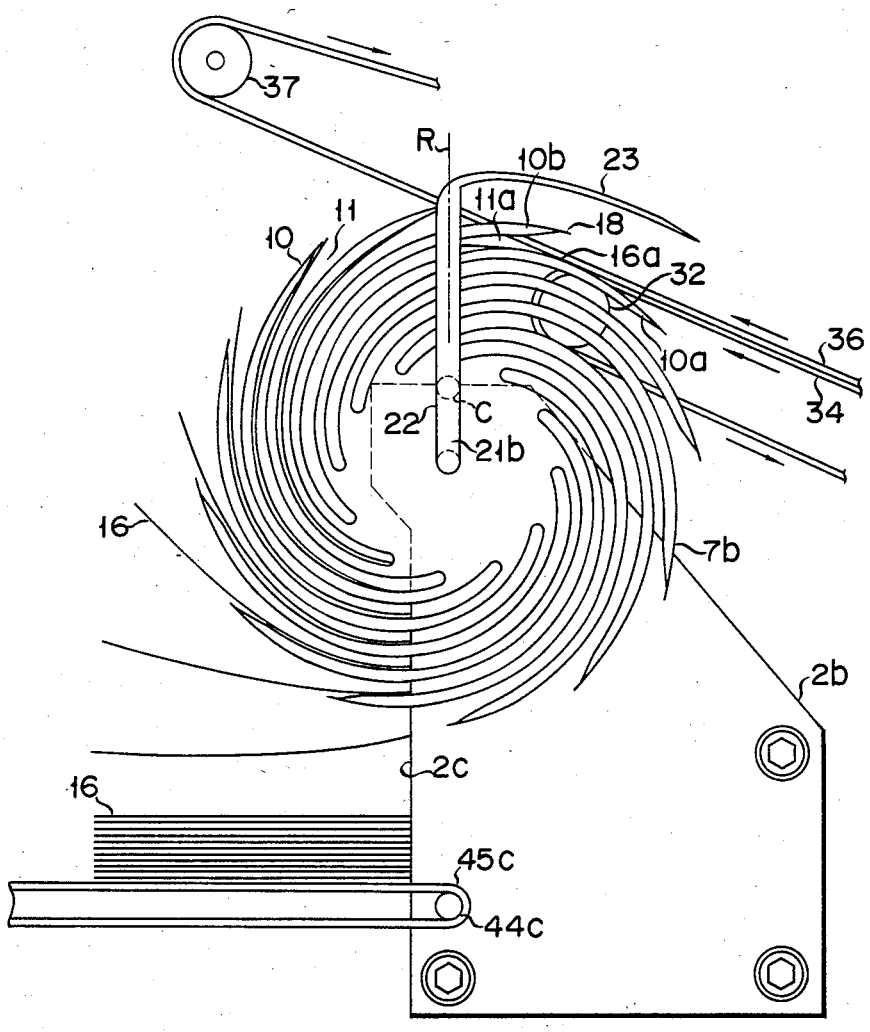

Now assume that the separators **21*a* and 21*b* stop at given positions or standby position (i.e., the position of the separator 21*b* which is aligned with the separator detector 52*b* as indicated by the dotted circle C in FIG. 1) where the separators 21*a* and 21*b* pass the feeding port of the belt mechanism 31 in the rotational direction of the blade wheels 7*a* and 7*b*, as shown in FIG. 10. The distance S between the arms 22 of the separators 21*a* and 21*b* is preset to be longer than the width W of the paper sheet 16. The receiving hands 23 are located outside the peripheral edges of the blade wheels 7*a* and 7*b*. The separators 21*a* and 21*b* are not brought into contact with the paper sheet, which is fed from the feeding port of the belt mechanism 31 and which is ready for insertion into the corresponding space 11 of the blade wheels 7*a* and 7*b*. Therefore, the paper sheet 16 is inserted from its leading edge into the space 11 whether or not the separators 21*a* and 21*b* are present. The insertion speed of the paper sheet 16 into the space 11 is decreased since the space forms an arc shape, so that the paper sheet 16 is entirely inserted in the space 11. The paper sheet 16 is rotated with the rotation of the blade wheels 7*a* and 7*b*. When the paper sheet 16 is rotated through about 180 degrees, the leading edge of the paper sheet 16 abuts against the left end surfaces 2*c* of the support plates 2*a* and 2*b*, disposed between the blade wheels 7*a* and 7*b*. As a result, the paper sheet stops. The left end surfaces 2*c* serve as the stops as previously described. Since the blade wheels 7*a* and 7*b* continue to rotate, the paper sheet 16 is gradually removed such that the rear edge side is discharged first from the space 11. The discharged paper sheet naturally drops in the horizontal state onto the belts 45*a*, 45*b* and 45*c* (see FIG. 2). Therefore, a paper sheet stack, the thickness of which is gradually increased, is stacked on the belts 45*a*, 45*b* and 45*c***.

In this state, since the arms 22 of the separators **21*a* and 21*b* are located at the side of the detector 52*b*, the optical path of the photocoupler is blocked by the bar 51. Therefore, the output from the detector 52*b* is held at low level. However, the optical path of the detector 52*a* is not blocked, so that the detector 52*a* generates the high output E1. The pulse generator 56 (FIG. 2) has the apertures 59 (FIG. 6) as previously described, so that the pulse generator 56 generates the output pulses F having a period of 50 ms. Similarly, the detector 66** generates the output pulses K having a period of 50 ms.

Figure 8:
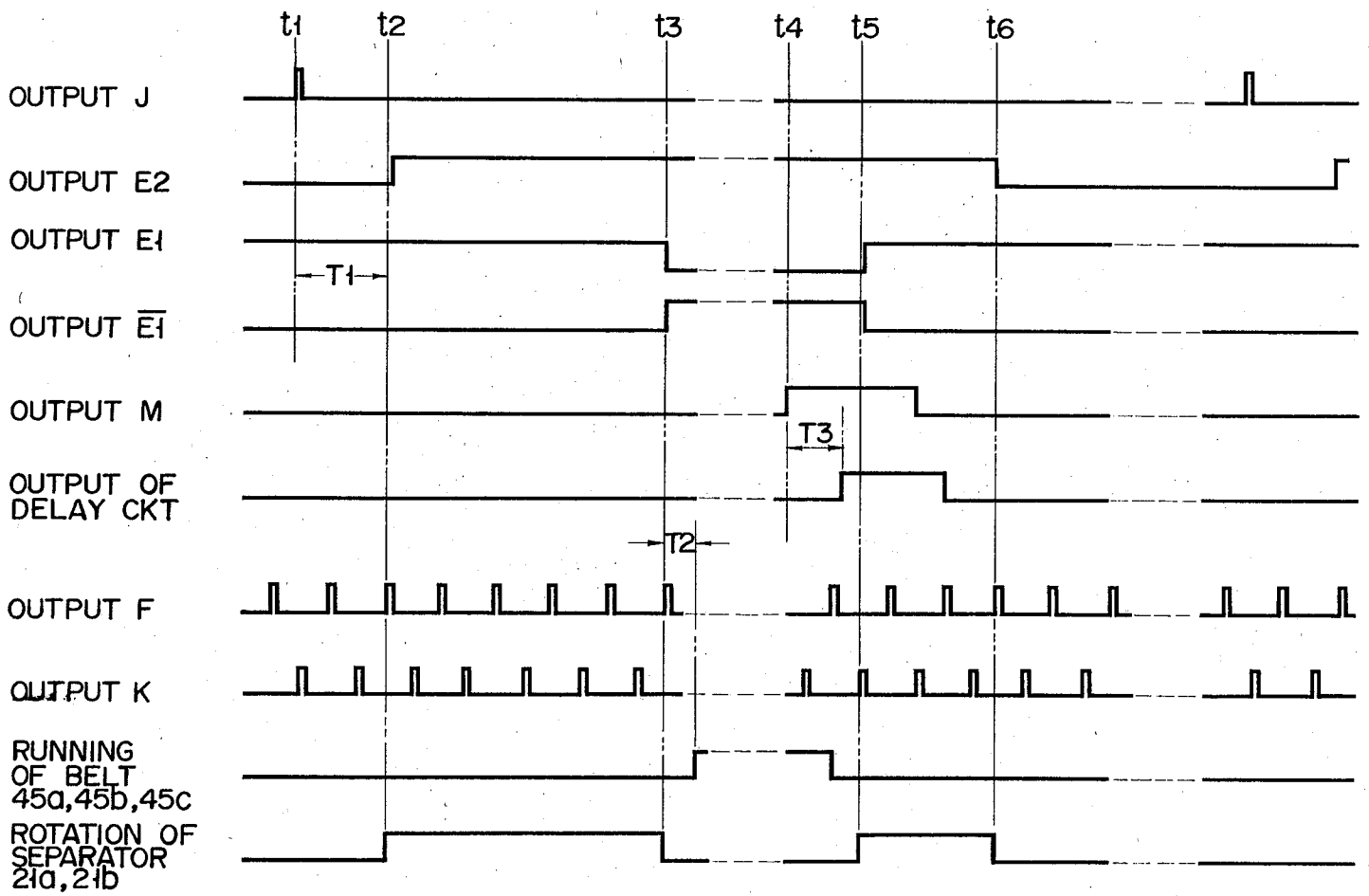
FIGS. 8 to 15 are views for explaining the operation of the apparatus shown in FIG. 1.
Figure 11:
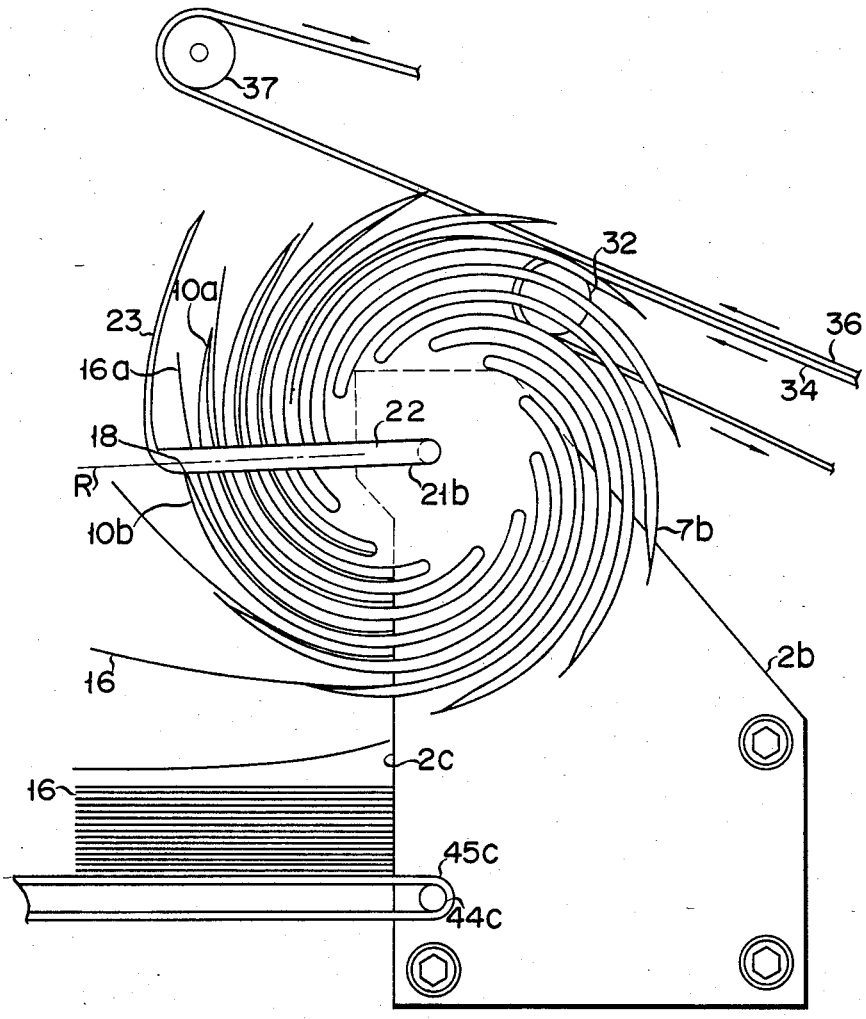

When the detector 63 detects the trailing edge of a 101st sheet following the predetermined number of 100 sheets, while the paper sheets 16 are sequentially stacked, the detector 63 generates the output pulse J as shown in the FIG. 8. The 101st sheet is the first sheet included in the next stack of sheets. The output pulse J is supplied to one input terminal of the AND gate 91 through the delay circuit 89 and the one-shot multivibrator 90 in the control unit or control means 81. A delay time T1 of the delay circuit 89 is preset as follows. Assume in FIG. 10 that a paper sheet **16*a*, inserted in a space 11*a* between blades 10*a* and 10*b*, is the 101st paper sheet. The delay time T1 is preset to be a time interval between a moment at which the trailing edge of the 101st paper sheet crosses the optical path of the detector 63 (i.e., t1) and a moment at which the tip 18 of the blade 10***b*, located immediately before the paper sheet 16*a*, is aligned with the central axis R of the arms 22 of the separators 21*a* and 21*b*. When the tip 18 of the blade 10*b* is rotated to align with the central axis R (i.e., when the tip of the paper sheet 16*a* passes by the arms 22 of the separators 21*a* and 21*b* and is inserted deep into the space 11*a*), the pulse generator 56 generates the output pulse F, as is apparent from the positional relationship between the apertures 59 shown in FIG. 6. This moment is given to be t2. The AND gate 91 is enabled in response to an output F2 at time t2, so that the one-shot multivibrator 96 is driven. On the other hand, at time t2, the output E1 of the detector 52*a* is at high level. The AND gate 88 is enabled at time t2, so that the transistors 99 and 102 are turned on. The output pulse from the pulse generator 98 is supplied to control the drive circuit 103 through the transistors 99 and 102. The pulse motor 14 is rotated to turn the separators 21*a* and 21*b* counterclockwise as in FIG. 11. The pulse generator 98 is constructed to generate pulses of a period such that the rotational speed of the blade wheels 7*a* and 7*b* coincides with that of the pulse motor 14. Therefore, the separators 21*a* and 21*b* are rotated at the same angular velocity as that of the blade wheels 7*a* and 7*b* in an identical direction, while the central axis R of the arms 22 is aligned with the tip 18 of the blade 10*b*, as shown in FIG. 11.

Figure 12:
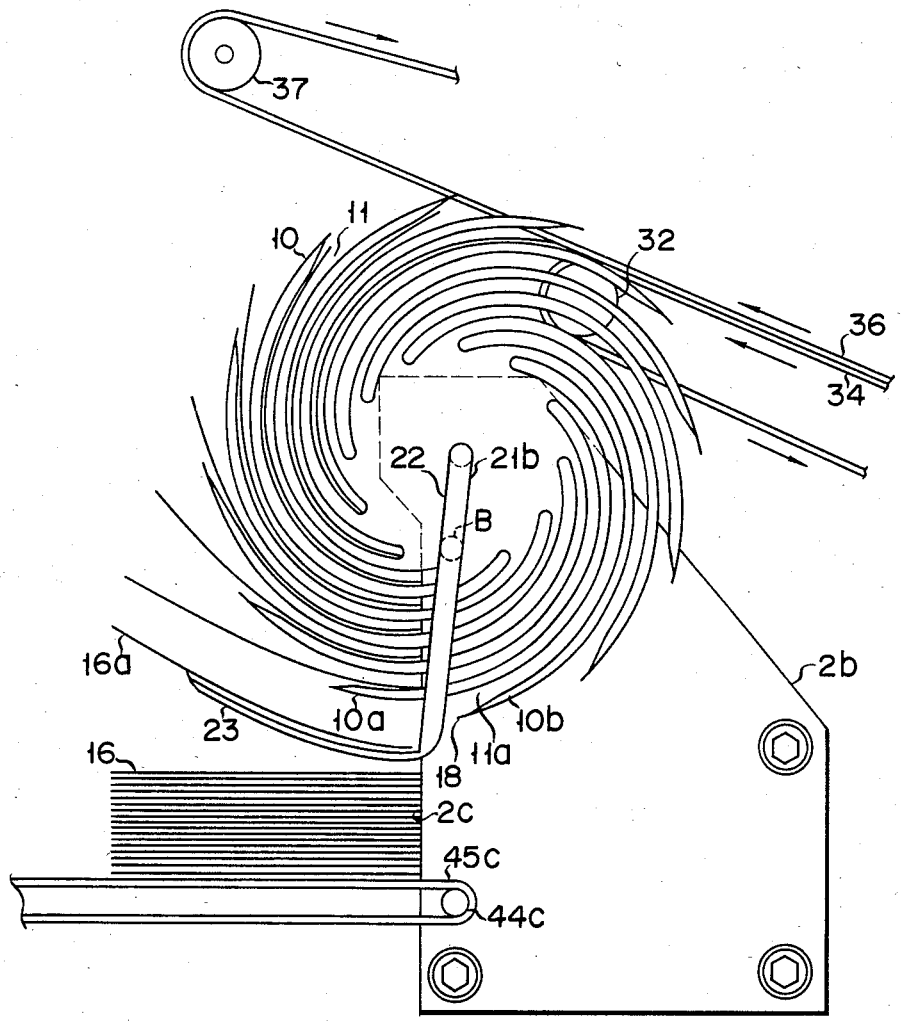

When the separators 21*a* and 21*b* are rotated by about half a revolution and reach their position at time t3 (i.e., when the separators are rotated at the side of the detector 52*a* which is indicated as a dotted circle B in FIG. 12), the bar 51 blocks the optical path of the photocoupler of the detector 52*a*, so that the output E1 of the detector 52*a* becomes low. As a result, the AND gate 88 is closed or disabled, and the transistors 99 and 102 are turned off. The pulse motor 14 then stops. This stop position is called a receiving position. The separator 21*b* (21*a*) stops at the position shown in FIG. 12. Meanwhile, the leading edge of the 101st paper sheet 16*a* inserted in the space 11*a* between the blades 10*a* and 10*b*, until the separators 21*a* and 21*b* stop at the receiving position, abuts against the stops 2*c* of the support plates 2*a* and 2*b*. The 101st paper sheet is gradually removed from the space 11*a* and completely discharged therefrom. The separators 21*a* and 21*b* are rotated in a state wherein the central axis R of the arms 22 is located at the side of the tip 18*a* of the blade 10*b*, so that the 101st paper sheet removed from the space 11*a* cannot drop downward but is received by the hands 23 of the separators 21*a* and 21*b*. FIG. 12 shows a state wherein the separators 21*a* and 21*b* stop and the blade wheels 7*a* and 7*b* are slightly rotated. Therefore, the 100th paper sheet is completely separated from the 101st paper sheet 16*a* by the receiving hands 23, so that the 101st and subsequent paper sheets are sequentially stacked on the receiving hands 23.

Figure 13:
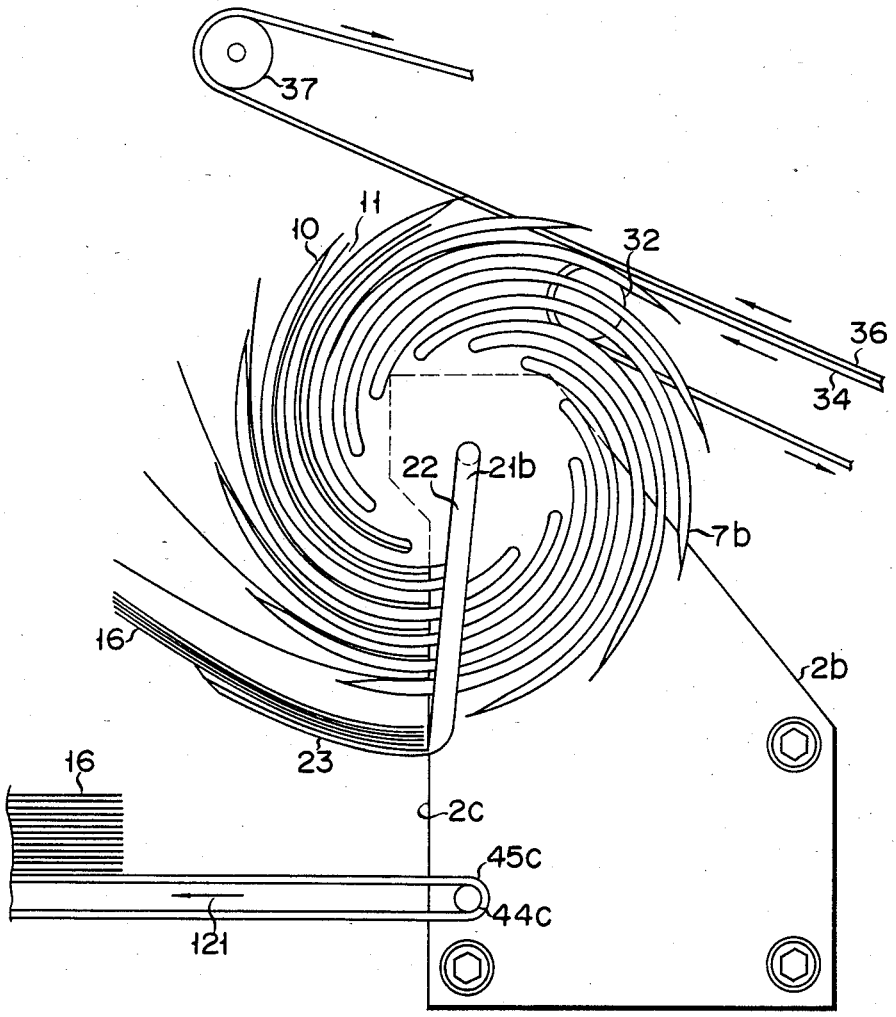

When the separators 21*a* and 21*b* stop and the output E1 from the detector 52*a* lowers, and output $\overline{E1}$ from the inverter 94 rises. The output $\overline{E1}$ is supplied to the delay circuit 108 and the differentiator circuit 109 for differentiating the leading edge of the output from the delay circuit 108. The output from the differentiator circuit 109 is supplied as the control signal for the drive circuit 111 of the motor 112 through the one-shot multivibrator 110. For this reason, when a time interval T2 has elapsed to give time t3, the motor 112 is started with the result that the belts 45*a*, 45*b* and 45*c* travel for a time interval preset by the one-shot multivibrator 110 in the direction indicated by an arrow 121 (FIG. 13). Therefore, the stack of paper sheets 16 below the blade wheels 7*a* and 7*b* are transferred to a suitable position so as not to interfere with the stacking of the next 100 paper sheets. The delay time T2 of the delay circuit 108 is preset to correspond to the time taken for the 100 paper sheets 16 to be completely cleared away. While the paper sheets stacked on the belts 45*a*, 45*b* and 45*c* are moved, the paper sheets 16 are sequentially stacked on the receiving hands 23.

When the stack on the belts 45*a*, 45*b* and 45*c* is completely cleared away from the position below the blade wheels 7*a* and 7*b* at time t4, the output M from the detector 69 rises. The output M is supplied to the AND gate 93 through the delay circuit 92. The delay time T3 of the delay circuit 92 is preset to correspond to the time interval between time t4 when the output M rises and the time when the belts 45*a*, 45*b* and 45*c* stop. In this manner, when the output from the delay circuit 92 rises, the output $\overline{E1}$ from the inverter 94 is at a high level.

Figure 14:
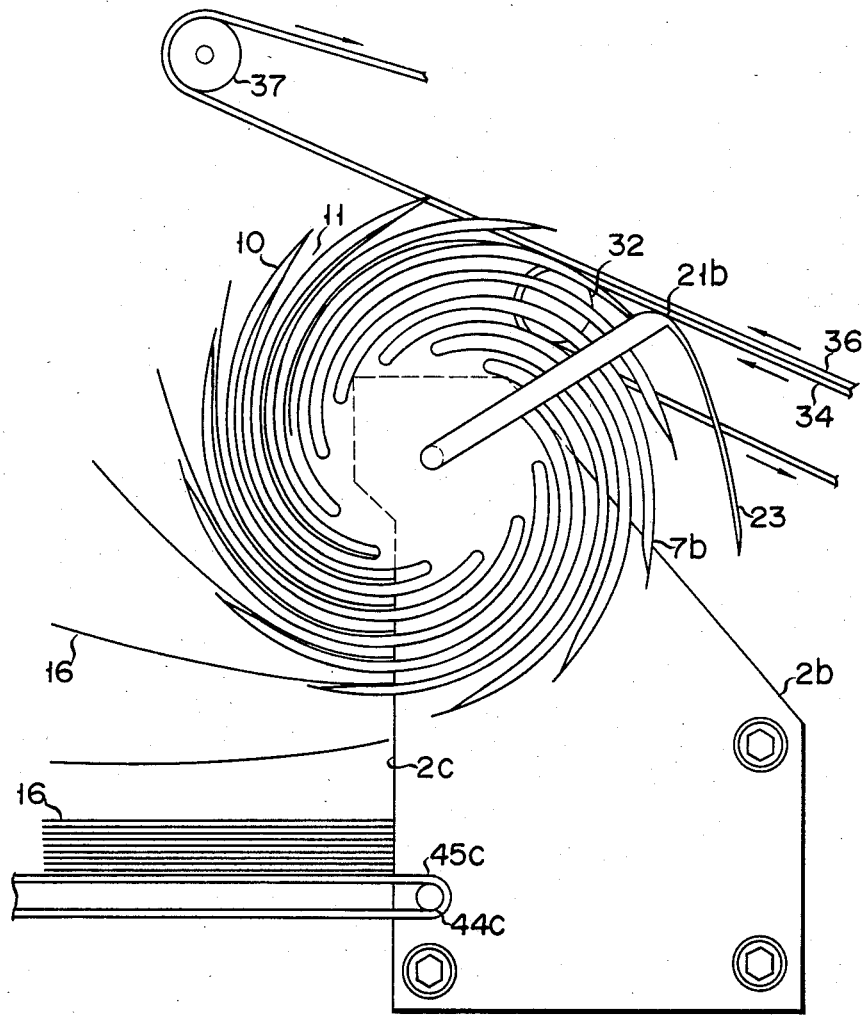

In this state, when a time interval has elapsed to give time t5, the detector 66 generates the output k, and the AND gate 93 is enabled. Therefore, the one-shot multivibrator 97 is driven. In this case, the output E2 from the detector 52*b* is set at high level, so that the AND gate 95 is enabled at time t5 to turn on the transistors 100 and 101. As a result, the output pulse from the pulse generator 98 is supplied to a control pulse system 120 through the transistors 100 and 101. The control pulse system 120 comprises the counter 104, the D/A converter 105 and the V/f converter 106, which are connected in series, and serves to move the separators from the lower position of FIG. 12 to the upper position of FIG. 15 at the time of acceleration. Details of this will be described later. The counter 104 in the control pulse system or control circuit 120 counts the pulses from the pulse generator 98 and supplies a count signal to the D/A converter 105. The D/A converter 105 generates a voltage corresponding to the count signal. This voltage from the D/A converter 105 is applied to the V/f converter 106, which converts it into a pulse signal having a pulse recurrence frequency corresponding to the output of the D/A converter. This signal is supplied to the pulse motor 14 through the drive circuit 103. Therefore, when the counter 104 starts counting the pulses generated from the pulse generator 98, the pulse motor 14 is also started from the stop state at a speed corresponding to the elapsed time. Therefore, the pulse motor 14 is started again from time t5, and the separators 21*a* and 21*b* are rotated in the same direction as that of the blade wheels 7*a* and 7*b*. Along with this rotation, the paper sheets 16 stacked on the receiving hands 23 of the separators 21*a* and 21*b* are transferred to the belts 45*a*, 45*b* and 45*c*, as shown in FIG. 14.

Figure 9:
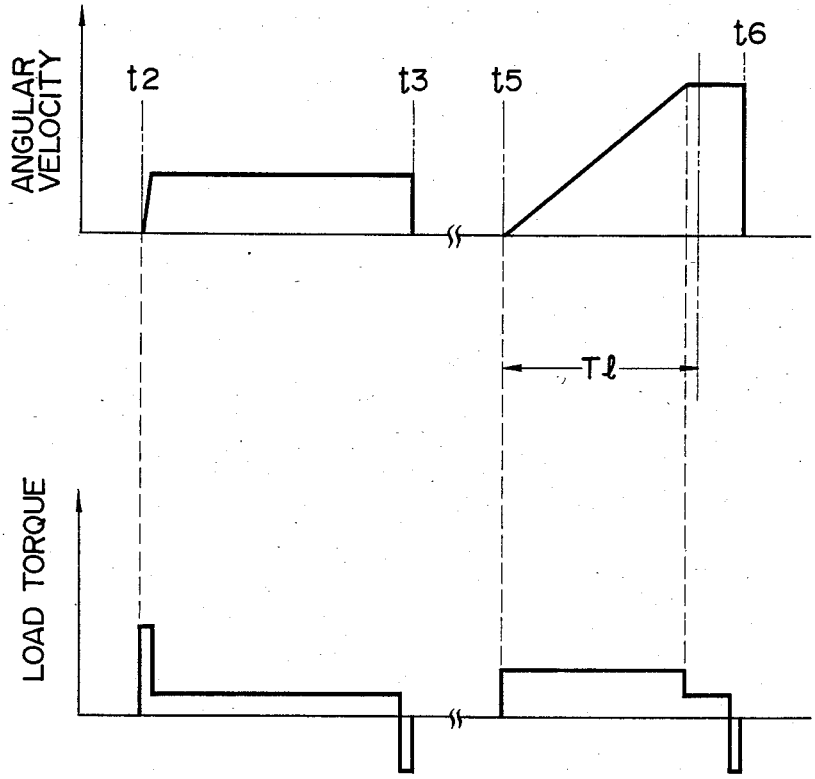

The control pulse system 120, comprising the counter 104, the D/A converter 105 and the V/f converter 106, is operated as follows. Assume that a position where the optical axis of the photocoupler of the detector 66 crosses the belt mechanism 31 is given to be X, that a position where a track Z of the receiving hands 23 crosses the belt mechanism 31 when the separators 21*a* and 21*b* are rotated is defined to be Y, then a distance l between the positions X and Y is constant. Since the travel speed of the belt mechanism 31 is predetermined, a time interval tl, during which the trailing end of the paper sheet 16 passes both X and Y, is constant. Therefore, when the paper sheets transported by the belt mechanism 31 have given intervals therebetween, the paper sheet which passes the position Y is not present during the given interval after the immediately preceding paper sheet passes through the position Y. This given time interval occures every 50 ms. In this embodiment, as shown in the right half portion of FIG. 9, after the pulse motor 14 is started at time t5, the rotational force is increased with a predetermined torque rate. Immediately before a time interval Tl from time t5 has elapsed, the control pulse system is operated such that the receiving hands 23 of the separators 21*a* and 21*b* pass by the position Y at a speed which is several times that of the travel speed of the belt mechanism 31. At the time of acceleration of the separators 21*a* and 21*b*, an overload need not be imposed on the pulse motor 14 since the paper sheets are not stacked on the receiving hands 23 of the separators 21*a* and 21*b*. Furthermore, the receiving hands 23 are not brought into contact with the paper sheets 16 transferred through the belt mechanism 31 and pass through the space between the sheets and past position Y, moving smoothly from the lower position of the belts 34 and 36 to the upper position thereof. The left half portion of FIG. 9 illustrates the relationship between the angular velocity and the loading torque of the pulse motor 14 when the separators 21*a* and 21*b* are moved from the state of FIG. 10 to the state of FIG. 12. Referring to FIG. 9, a positive or negative torque acts on the separators 21*a* and 21*b* when the angular velocity changes. However, when the angular velocity is constant, a relatively low torque acts on the separators 21*a* and 21*b* for overcomming a bearing frictional force. When the angular velocity is increased at a predetermined rate during the time interval Tl, a relative high torque acts on the separators 21*a* and 21*b* against the inertia force thereof.

Figure 15:
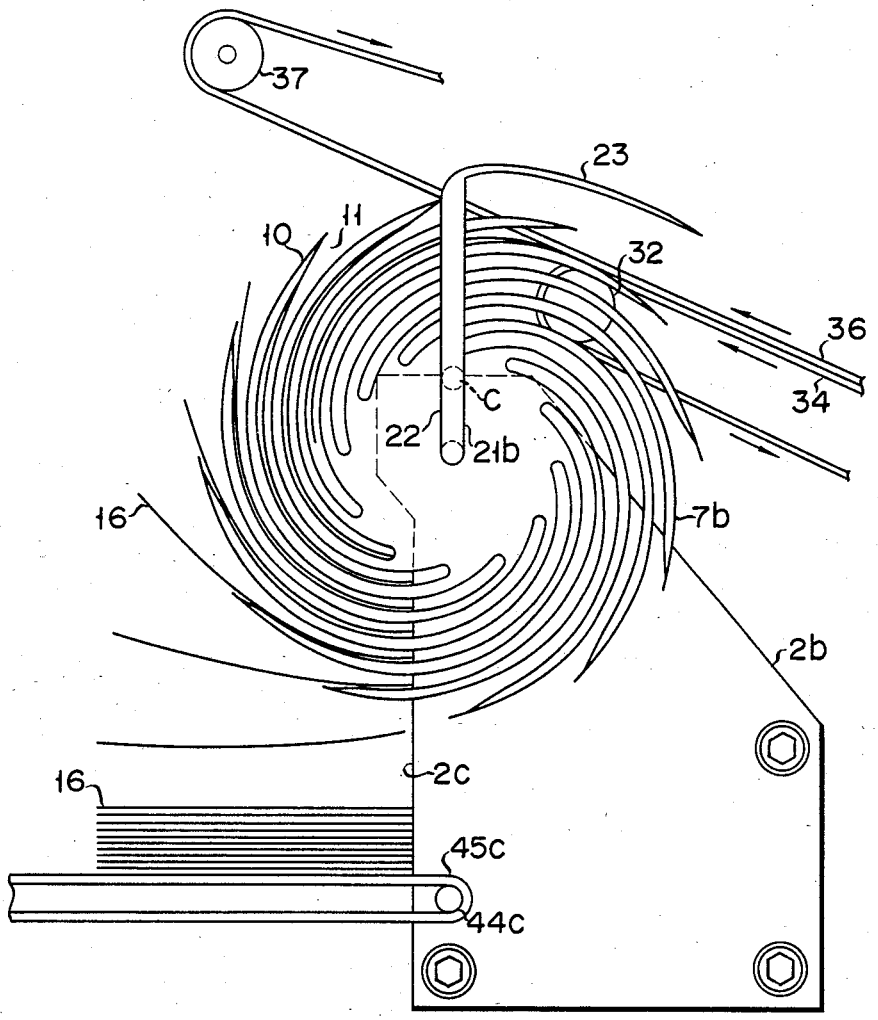

The separators 21*a* and 21*b* are rotated as described above, the receiving hands 23 extend above the blade wheels 7*a* and 7*b*, as shown in FIG. 15, and the arms 22 reach at the side of the detector 52*b*, so that the bar 51 blocks the optical path of the photocoupler of the detector 52*b* at time t6. At this time, the output E2 from the detector 52*b* lowers. As a result, the AND gate 95 is closed to turn off the transistors 100 and 101. At the same time, the counter 104 is reset in response to the output from the differentiator circuit 107. Therefore, the motor 14 is stopped, and the separators 21*a* and 21*b* stop at a position i.e. standby position indicated in FIGS. 10 and 15 are set in the standby mode. Thereafter, the above operation is repeated in response to the output J from the detector 63. Therefore, the paper sheets 16, fed one by one edgewise, can be sorted in units of 100 sheets, and the 100-sheet groups are fed in the subsequent unit, thereby providing efficient handling of the stacking apparatus having the sorting means.

In the stacking apparatus of the present invention, the arms 22 of the separators 21*a* and 21*b* are located at positions (i.e., outside the two ends of the paper sheet inserted in the spaces 11 of the blade wheels 7*a* and 7*b*) where the arms 22 will not be brought into contact with the paper sheets 16, so that the travel path of the paper sheet to be inserted in the space 11 will not be interfered with by the arms 22, irrespective of the positions of the separators 21*a* and 21*b*. Therefore, the feeding rate of the paper sheets is not limited due to the presence of the separators 21*a* and 21*b*. The paper sheets are continuously fed, grouped and discharged in the subsequent process.

The present invention is not limited to the above embodiment. In the above embodiment, the separators 21*a* and 21*b* stop at the standby position of FIG. 10 or the receiving position of FIG. 12. However, the separators 21*a* and 21*b* may stop at an intermediate position (as illustrated in FIG. 14) between the standby position and the receiving position. In this case, the control circuit may be arranged such that the receiving hands 23 of the separators 21*a* and 21*b* pass through a space formed between the paper sheets 16 at a speed several times the travel speed of the belt mechanism 31. In this case, the loading torque of the pulse motor 14 is increased as compared with that in the above embodiment. However, the time interval between the time at which the separator 21*a* and 21*b* start and the time at which the separators 21*a* and 21*b* pass across the travel path of the sheets 16 is short, so that the determining timing of the movement of the receiving hands 23 across the travel path of the sheet 16 can be simplified. In addition to this modification, the moving speed of the separators 21*a* and 21*b* may become the same as that of the blade wheels 7*a* and 7*b* to rotate the separators 21*a* and 21*b* in the direction from the standby position toward the receiving position in the same manner as in the above embodiment. In the above embodiment, the separators 21*a* and 21*b* are rotated through 360 degrees. However, the separators 21*a* and 21*b* may be rotated through 180 degrees, or therewithin, and may be controlled with an axial movement control system. In this case, only one separator is arranged and a fork-like receiving hand is formed integrally at the distal end of the arm. As shown in FIG. 12, when the receiving hands receive the paper sheets having numbers larger than a predetermined number, the stacked paper sheets on the stacking unit 41 are discharged, and the paper sheets stacked on the receiving hands are transferred to a substacking unit (not shown) by utilizing an open space of the receiving hands 23. Thereafter, the separator is axially moved such that the receiving hand 23 is cleared away from the lower portion of the blade wheels 7*a* and 7*b*. Subsequently, the paper sheets stacked on the substacking unit are moved onto the main stacking unit, and the separator is rotated through a predetermined angle in the direction opposite to the rotational direction of the blade wheels. The separator is then moved in the direction opposite to the direction described above so as to face the receiving hand at the outer surfaces of the blade wheels. The separator is then rotated from the standby position to the receiving position in the same manner as in the above embodiment. A series of operations described above are then repeated. The same effect as in the above embodiment can be obtained in this modification. In addition, the blades of the blade wheels are formed in an involute curve. However, the shape of the blades is not limited to this curve but can be extended to a different known shape.

What is claimed is:

1. A stacking apparatus for paper sheets having blade wheel means which is rotated such that an axis of rotation thereof is horizontally aligned and which has elongated blades extending in a direction opposite to a rotational direction of said blade wheel means from a center portion to a peripheral surface of said blade wheel means, feeding means for feeding the paper sheets one by one in each of elongated spaces formed between every two adjacent blades of said elongated blades at a speed exceeding a peripheral velocity of said blade wheel means, stationary stops for stopping rotation of the paper sheet at a position where the paper sheet, inserted in a corresponding one of said elongated spaces, is rotated through a predetermined angle with rotation of said blade wheel means and for removing the paper sheet from said corresponding space to naturally drop the paper sheet;

stacking means for stacking the paper sheets sorted by and sequentially discharged in groups of a predetermined number from said blade wheel means;

a pair of arms each having substantially the same axis of rotation as that of said blade wheel means and passing by the side of paper sheets at a predetermined distance from said side, said paper sheets being supported to be rotated while said arm is not brought into contact with the paper sheets inserted in said elongated spaces, and which extends along a side surface of said blade wheel means;

a pair of receiving portions each supported by one said arm and located outside a peripheral edge of said blade wheel means so as to temporarily receive the paper sheet which naturally drops, said receiving portions being located at a common angular position about said axis upon receipt of said paper sheet and being arranged at a predetermined distance from the peripheral edge of said blade wheel means and each said receiving portion extending from said arm in a direction substantially parallel with said peripheral edge; and controlling means including a control system for positioning said arm in a receiving position for temporarily stacking said paper sheets removed from said elongated space.

2. An apparatus according to claim 1, wherein said blade wheel means has first and second blade wheels, said blades of which are aligned with each other along the axis of rotation and spaced apart by a distance shorter than a width of the paper sheet along a direction perpendicular to a feeding direction of the paper sheets, said feeding means, disposed between two blade wheels has pairs of upper and lower conveyer belts, and each pair of which has a feeding port formed between said first and second blade wheels in a vicinity of a peripheral portion of each of said first and second blade wheels, and said stationary stops are formed adjacent side surfaces of said first and second blade wheels.

3. An apparatus according to claim 1 or 2, wherein said arm comprises a plurality of aligned arms.

4. An apparatus according to claims 1 to 2, wherein said controlling means further includes a control system for positioning said arm in a standby position.

5. An apparatus according to claim 4, wherein said controlling means includes a control system for starting rotation up to said stop position after a leading edge of a first paper sheet of said paper sheets, which is to be received by said receiving portion, passes through the standby position where said arm is positioned.

6. An apparatus according to claim 5, wherein said controlling means includes a control system for rotating said arm at the same angular velocity as that of said blade wheel means.

7. An apparatus according to claim 1, wherein said controlling means includes a control system for stopping said arm at the receiving position to temporarily receive the paper sheet discharged from said blade wheel means on said receiving portion, for rotating said arm about the axis of rotation in the same direction as the rotational direction of said blade wheel means at a speed exceeding a travel speed of said belt mechanism, and for stopping said arm at the standby position.

8. An apparatus according to claim 7, wherein said controlling means includes a control system for accelerating said arm with a predetermined angular acceleration.

9. An apparatus according to claim 1, wherein said controlling means includes a control system for stopping said arm at the receiving position to transfer a holding function of the paper sheets to said stacking means while the paper sheets, discharged from said blade wheel means, are temporarily held in said receiving portion, a control system for removing said arm from the bottom of the paper sheets stacked on said stacking means, a control system for setting at the standby position said arm for supporting said receiving portion removed from the bottom of said paper sheets, and a control system for rotating said arm from the standby position to the receiving position at the same speed as the angular velocity of said blade wheel means and for stopping said arm at the receiving position when a drive start instruction for said arm is received.

10. A stacking apparatus for paper sheets to group and stack the paper sheets sequentially supplied one by one at a predetermined interval therebetween in units of predetermined number, comprising:

two blade wheels which have an axis of rotation which is aligned substantially horizontal and which are rotatably supported to be spaced apart from each other, each of said two blade wheels being provided with a plurality of blades extending outwardly from a center portion around the axis of rotation in a direction opposite to a rotational direction of said two blade wheels and formed to define spaces between every two adjacent blades of said plurality of blades;

paper sheet feeding means for inserting the paper sheets respectively in said spaces through corresponding openings thereof one at a time at a predetermined position where each one of said openings is positioned upon rotation of said two blade wheels;

a stop which abuts against the paper sheet which is inserted in a corresponding one of said spaces and is rotated together with said two blade wheels, and which removes the paper sheet from said corresponding space to naturally drop the paper sheet on a predetermined stacking position;

stacking means for receiving the paper sheets discharged from said two blade wheels to form a paper sheet stack and for clearing the current predetermined paper sheet stack from a predetermined stacking position to receive a next stack;

two separators rotatably supported to be coaxial with said two blade wheels, and controlling means for controlling rotational movement of said two separators, said two separators are provided with two arms, which are spaced apart from outer sides of said two blade wheels, such that said arms are rotatably supported while said arms are not brought into contact with the paper sheets inserted in said two blade wheels, and which have distal ends radially extending outside peripheral edges of said two blade wheels, and two receiving hands extending from said distal ends of said two arms and parallel with said peripheral edges of said two blade wheels, said two receiving hands being arranged between said two arms so as to come closer to each other and to be spaced apart from each other by a distance shorter than a width of the paper sheet, and said controlling means is operated to drive said separators such that a leading blade of the adjacent two blades of said blade wheel, between which first one of the predetermined number of paper sheets is received, is rotated at the same velocity as that of the blade wheels;

said separators then stop at a position where said first and subsequent paper sheets, discharged from the blade wheel, are received and stacked temporarily on said receiving hands of the separators;

said separators are further driven to rotate when a predetermined stacking position on said stacking means is cleared to transfer the paper sheets on the receiving hands onto said stacking means and the subsequent paper sheets discharged from the blade wheels drop directly onto said stacking means.

* * * * *